United States Patent [19]

Stoy et al.

[11] Patent Number: 4,841,761

[45] Date of Patent: Jun. 27, 1989

[54] MULTIPURPOSE ROLLING MILL

[75] Inventors: Erich Stoy, Ratingen; Wilfried Bald, Hilchenbach; Hans Römmen, Dormagen, all of Fed. Rep. of Germany

[73] Assignee: SMS Schloemann-Siemag Aktiengesellschaft, Dusseldorf, Fed. Rep. of Germany

[21] Appl. No.: 165,699

[22] Filed: Mar. 9, 1988

[30] Foreign Application Priority Data

Mar. 10, 1987 [DE] Fed. Rep. of Germany ..... 3707560

[51] Int. Cl.[4] ..... B21B 31/08; B21B 13/14

[52] U.S. Cl. ..... 72/238; 72/199; 72/241; 72/243

[58] Field of Search ..... 72/238, 239, 237, 241, 72/247, 199, 242

[56] References Cited

U.S. PATENT DOCUMENTS

| | | | |
|---|---|---|---|
| 4,440,012 | 4/1984 | Feldmann et al. | 72/247 X |
| 4,519,233 | 5/1985 | Feldmann et al. | 72/241 |
| 4,531,394 | 7/1985 | Turley et al. | 72/238 |
| 4,763,505 | 8/1988 | Klute et al. | 72/238 |

FOREIGN PATENT DOCUMENTS 0059417 1/1985 European Pat. Off. .

*Primary Examiner*—Lowell A. Larson
*Assistant Examiner*—Steven B. Katz
*Attorney, Agent, or Firm*—Herbert Dubno

[57] ABSTRACT

The rolling mill comprises a plurality of working rolls and supporting rolls or a plurality of working rolls, intermediate rolls and supporting rolls. The intermediate rolls with their mounts and the slender working rolls used with them in six-high operation are exchangeable with or replaceable by larger thicker working rolls for two-high operation. No contact can occur between the body of a working roll and the body of the adjacent supporting roll during use as a two-high mill. In two-high operation the mount of a working roll is provided with a spacer piece engaging against the mounting member of the adjacent supporting roll. The mounts of the thicker working rolls used in two-high operation can be fitted into the guide pieces which act as guides for the mounting pieces of the intermediate rolls when the rolling mill is used as a six-high mill.

9 Claims, 5 Drawing Sheets

MULTIPURPOSE ROLLING MILL

CROSS REFERENCE TO RELATED APPLICATION

This application is related to the commonly assigned copending applications: Ser. No. 06/710,837, filed Mar. 12 1985, now abandoned, Ser. Nos. 06/912,200 now U.S. Pat. No. 4,712,416, and 06/911,959, now U.S. Pat. No. 4,711,116, both filed Sept. 25, 1986.

FIELD OF THE INVENTION

Our invention relates to a rolling mill stand for making a rolled product, particularly rolled strip.

BACKGROUND OF THE INVENTION

A rolling mill stand for making a rolled product, particularly a rolled strip, generally has a pair of working rolls and a pair of supporting or backup rolls. The stand can be further provided with intermediate rolls between the backup and working rolls.

A rolling mill stand of this type is described in European Pat. No. 00 59 417.

The known mill is provided with a roll bending unit in which piston-and-cylinder units associated with anchored blocks anchored in the stand window are attached with mounting pieces (journal blocks) of the intermediate rolls guided between the anchored blocks and act on both sides to apply forces for working roll body correction (e.g. by bending).

A guide piece is guided vertically slidable in each block. The guide pieces are attached to the mounting pieces so as to be formfittingly held thereon so that these pieces can be horizontally guided into and out of the stand window. A variety of uses for this known rolling mill, for example as a reversing mill and/or a finishing or dressing mill, are not suggested in this position.

In fact, a separate finishing mill generally is used as required. In many cases it would be advantageous if the same rolling mill could be used for different applications so that investment costs could be reduced. This is especially desirable for processing smaller size lots. Usually comparatively long changing times up to eight hours have been necessary when the working, intermediate and supporting rolls are removed from the roll stand for changing from six-high operation to two-high operation and are replaced by fresh working rolls. Also structural adaptations required, especially for the roll drive, are associated with increased costs.

OBJECTS OF THE INVENTION

It is an object of our invention to provide an improved rolling mill, especially an improved rolling mill capable of processing different size lots and different size products, which does not have the above mentioned disadvantages and difficulties.

It is also an object of our invention to provide an improved rolling mill, especially an improved rolling mill capable of processing smaller lot sizes economically, which in a simple way can be adjusted for different uses without impairing the quality of its products.

It is another object of our invention to provide an improved rolling mill which in a simple way can be adjusted for different uses without impairing the quality of its products and with which a trouble free production operation is guaranteed with guaranteed with relatively short changing times.

SUMMARY OF THE INVENTION

These objects and others which will become more readily apparent hereinafter are attained in accordance with our invention in a rolling mill for making a rolled product, particularly a rolled band or strap, having working rolls, respective backup rolls, and an intermediate roll located respectively between each working roll and the associated backup roll.

According to our invention, means are provided whereby the intermediate rolls with their respective mounts or journal blocks and slender working rolls associated therewith are replaced by thicker working rolls while the backup rolls remain in the stand.

In this way the rolling mill according to our invention can be used as a six-high finishing mill or also advantageously as a two-high mill or a four-high mill. The intermediate-roll-bending block can be used advantageously as a working-roll-bending block for the new working rolls in two-high or four-high operation.

Advantageously, the replaceable rolls comprise a quick change unit which is mounted in the stand window. Thus the intermediate rolls and the slender working rolls with their mounting pieces and mounting members comprise a kind of "cassette" which is in a simple way interchangeable with another "cassette" with two working rolls.

There is advantageously no contact between the body of a thick working roll and the body of the adjacent supporting roll when the rolling mill is used as a two-high stand. A rolling mill operated as a individual six-high reducing rolling mill and/or reversing rolling mill, e.g. for rolling steel strip with an initial thickness of about 8 mm to a final thickness of about 0.40 mm, can be used as a two-high finishing mill in the same roll stand in the same way.

Moreover the intermediate and working rolls of the six-high roll arrangement are replaceable by a two-high arrangement in which an air gap remains between the backup rolls and the new working rolls.

In four-high operation inasmuch as higher rolling forces must be transmitted, the air gap between the working and backup rolls can be easily returned to zero so that transfer of rolling forces can occur directly between the backup rolls and the working rolls and not as in the two-high stand by contact of the mounting members of the supporting roll on the mounts of the working rolls. The working rolls can usually be individually or together exchanged in a short period of time while the backup rolls remain in the mill.

An advantageous form of our invention provides that the mounts of the working rolls are fitted with spacer pieces engaging against the mounting members of the backup rolls. The mounts of the working rolls are fitted into guide pieces which act as guides for the mounting pieces of the intermediate rolls during operation as a six-high mill. Particularly, retaining and guiding devices can thus be omitted so that cost can be reduced.

In another development, the spacer pieces are plates and are releasably attached to the mounts of the working rolls. This is an especially simple and economical feature which provides an air gap between the working and backup rolls in a two-high finishing operation.

Several plates positioned over each other advantageously can form a single spacer piece. The total thickness of the spacer piece is adjusted to the roll wear expected and/or allowed so that an air gap can be continuously maintained between the working and backup rolls during operation of the rolling mill as a two-high mill.

Further, the spacer piece can advantageously be formed to fit together with a mounting piece so as to be held in place. This feature guarantees an especially quick change and/or assembly of the spacer piece.

In many forms of our invention the working rolls have a curved body contour or shape, especially an asymmetric shape curved differently in the direction of both ends. An optimum influence of the roll gap on adjustment on the one hand to the surface properties of the rolled material and on the other hand to the roll wear is provided.

Moreover the backup rolls and/or the intermediate rolls can have a curved shape which is different in the direction at both ends, especially an asymmetric shape whereby the roll gap is effected similarly. Particularly in connection with the simultaneously shaped working rolls and/or intermediate rolls, there can be provided an especially exact fit of the roll gap to other rolling conditions.

A bottle shape of the rolls is preferred.

BRIEF DESCRIPTION OF THE DRAWING

The above and other objects, features and advantages of our invention will become more readily apparent from the following description, reference being made to the accompanying highly diagrammatic drawing in which.

SPECIFIC DESCRIPTION

Figure 1:
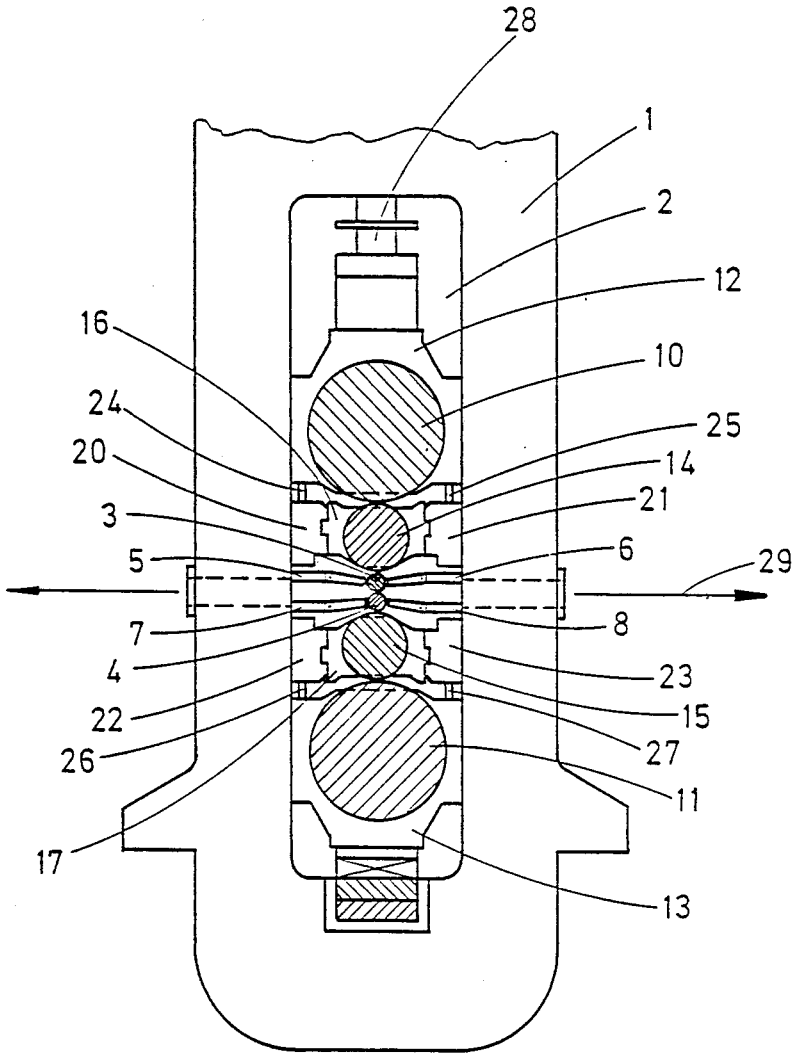
FIG. 1 is a schematic simplified vertical cross sectional view of one embodiment of a rolling mill stand according to our invention taken along a direction parallel to the rolling direction being used as a six-high reducing mill stand.

According to FIG. 1 the illustrated six-high rolling mill stand has two roll stand frames 1 placed side-by-side in the usual way of which only one is shown in cross section. The roll stand frames 1 each have a roll stand window 2 in which two slender working rolls 3, 4 are received which are supported on both sides by support arms 5, 6; 7, 8 as is known. The backup rolls 10, 11 similarly located in the rolling mill stand 1 and/or in the stand window 2 are mounted at their ends in mounting members 12, 13. Intermediate rolls 14, 15 are located between the slender working rolls 3, 4 and the backup rolls 10, 11 and are held by their mounting pieces 16, 17.

In the vicinity of the intermediate rolls 14, 15 stationary blocks are located in the stand windows 2 of both roll stands 1 with guide pieces 20, 21; 22, 23, which are guides vertically slidable in the stationary blocks. The mounting pieces 16, 17 for both intermediate rolls 14, 15 fitted together with the guide pieces so as to be held fixed in the vertical direction but are slidable horizontally in guide pieces 20 to 23 for replacement.

Adjusting means which each comprise a hydraulically driven piston-cylinder unit in the vicinity of the stationary blocks are associated with the mounting pieces 16, 17 of the upper and lower intermediate rolls 14, 15. These adjusting means and/or bending devices 24-27 for the intermediate rolls are built into the associated guide pieces 20–23. A positioning device 28 for the rolling mill stand is engaged with the mounting member 12 of the upper supporting roll 10.

In operation of the rolling mill stand as a six-high reversing mill stand, the roll forces are transferred by the mounting members 12, 13 to the backup rolls 10, 11 and then to the intermediate rolls 14, 15 by the backup rolls with the intermediate rolls 14, 15 on them in the resting configuration and from there to the working rolls 3, 4 and/or the product rolled in the roll plane 29.

Figure 2:
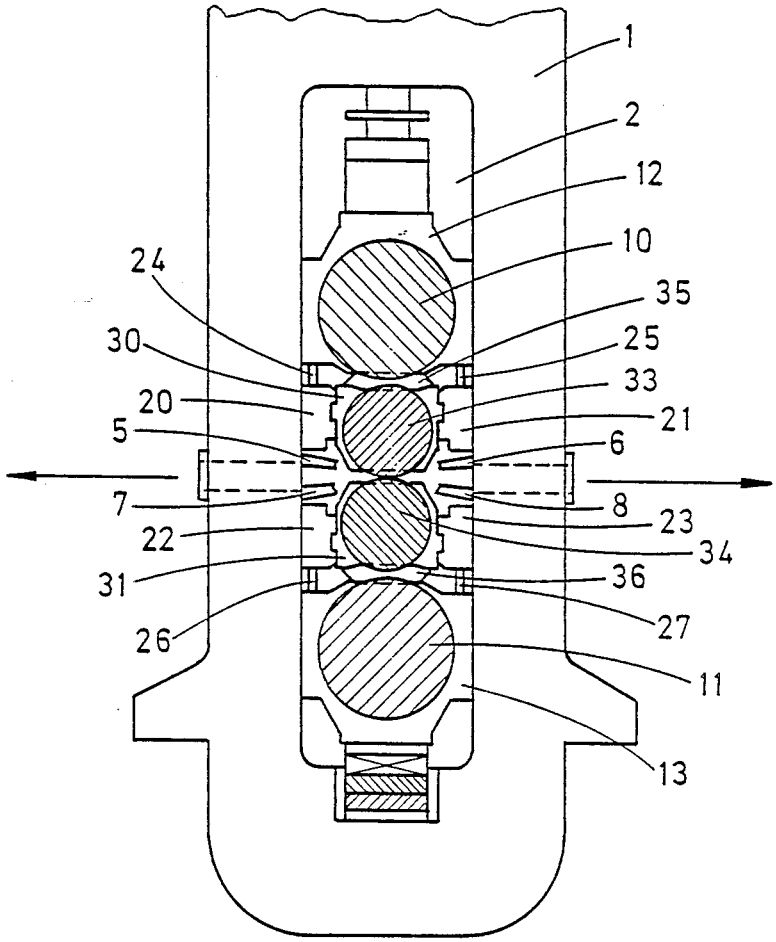
FIG. 2 is a schematic simplified vertical cross sectional view of the rolling mill stand according to FIG. 1 being used as a two-high finishing mill stand with a spacer piece.

FIG. 2 shows the use of the rolling mill stand according to our invention as a two-high finishing mill stand. The mounts 30, 31 of the newly reinforced working rolls 33, 34 are provided with spacer pieces 35, 36 contacting against the mounting members 12, 13 of the backup rolls 10, 11 so that no contact exists between the body of the supporting roll 10, 11 and the body of the thick working roll 33, 34. The mounts 30, 31 of the working rolls 33, 34 fitted in the guide pieces 20–23 which act as guides for the mounting pieces of the intermediate rolls when the rolling mill stand is used as a six-high mill stand according to FIG. 1 (see, for example, in FIG. 1, mounting pieces 16, 17; intermediate rolls 14, 15). The intermediate roll bending blocks with the adjusting means 24-27 can advantageously be used as a new working roll bending block for bending the working rolls 33, 34. The spacer pieces 35, 36 are plates and are attached detachably with the mounts or mounting pieces 30, 31 of the working rolls 33, 34.

Figure 3:
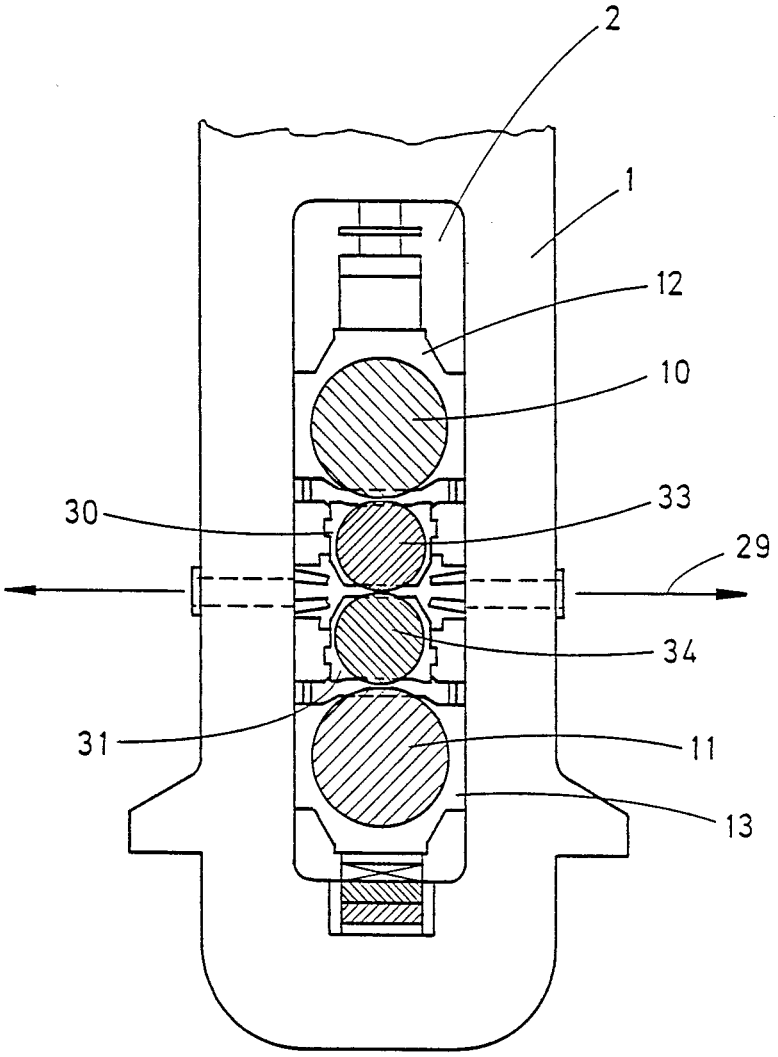
FIG. 3 is a schematic simplified vertical cross sectional view of the rolling mill stand according to FIG. 1 being used as a four-high mill stand.
Figure 4:
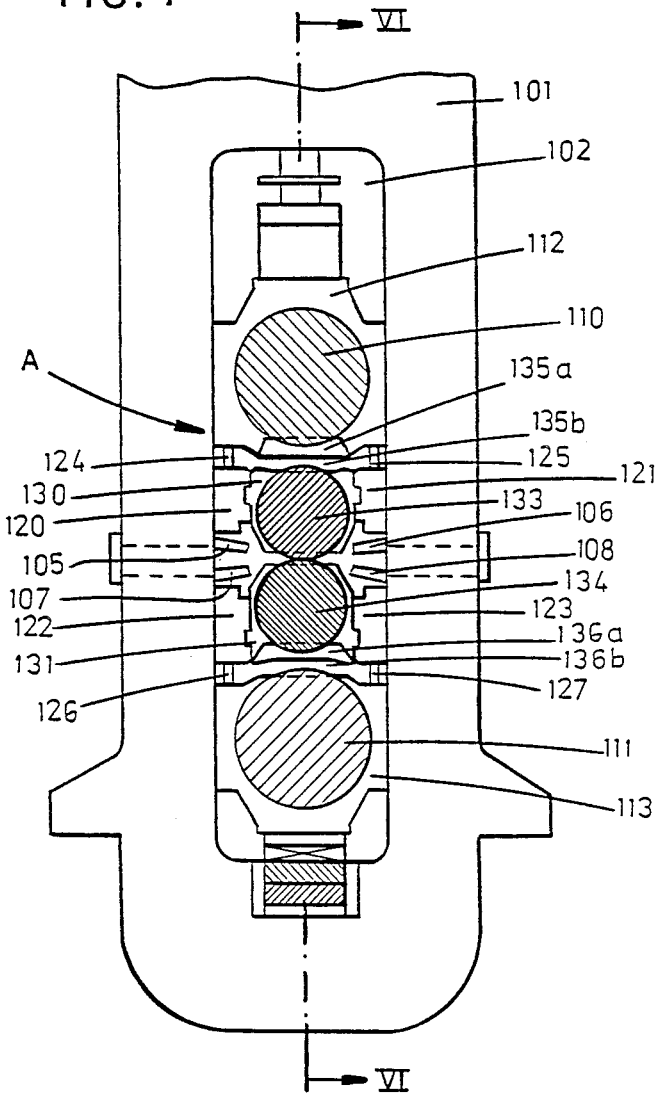
FIG. 4 is a schematic simplified vertical cross sectional view of another embodiment of a rolling mill stand according to our invention taken along a direction parallel to the rolling direction being used as a two-high finishing mill stand with a twin plate spacer piece.
Figure 5:
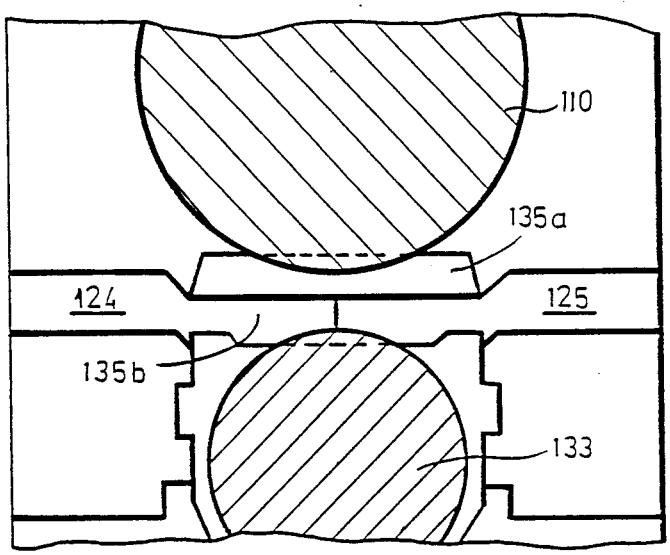
FIG. 5 is a magnified portion of the cross sectional view of the rolling mill stand of FIG. 4 showing the details of the spacer piece.
Figure 6:
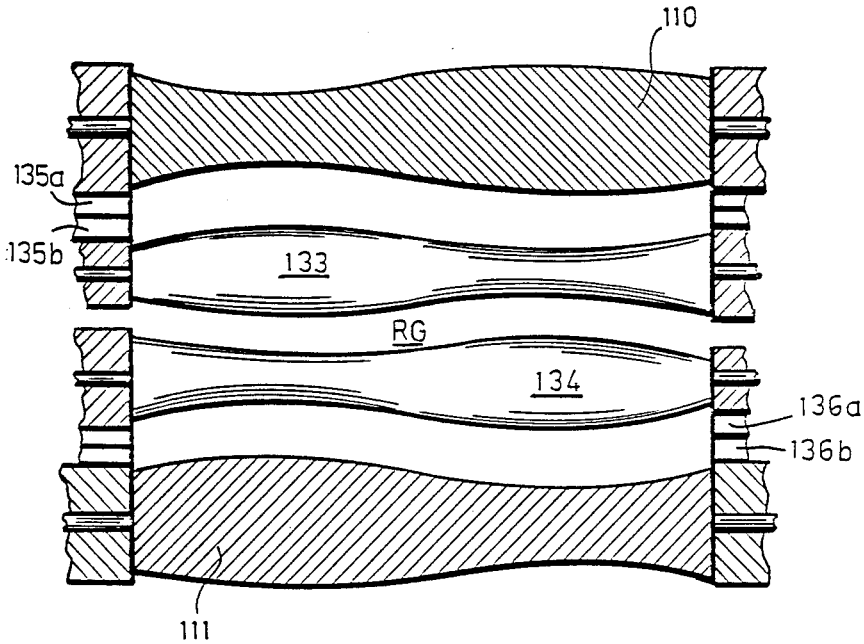
FIG. 6 is a cross sectional view taken along the section line VI—VI in FIG. 4.

FIGS. 4 to 6 show another embodiment of our invention in which a plurality of plates positioned over each other can form a single spacer piece. In this embodiment parts which are the same as in the embodiment of FIGS. 1 to 3 are labelled with the corresponding number in the 100's (i.e., the reference number for the embodiment of FIGS. 4 to 6 is equal to the reference number for the part in FIGS. 1 to 3 plus 100). The only difference between the embodiments is that instead of the one plate spacer piece 35, 36 shown in FIG. 2 the spacer piece comprises two plates **135*a*, 135*b* and 136*a*, 136*b*. FIG. 5** is simply a magnified view of the rolling mill stand in the vicinity of the spacer piece.

To change the rolling mill stand from a six-high mill stand to two-high mill stand the intermediate rolls with their mounts and the slender working rolls (see FIG. 1, particularly pieces indicated with reference characters 14, 15; 16, 17; 3, 4) are withdrawn as a quick change unit from the stand windows 2 whereby the supporting arms 5–8 travel as far as possible hydraulically to provided a space for the thicker working rolls 33, 34 and their mounts or mounting pieces 30, 31. The mounting members 12, 13 with the backup rolls 10, 11 are moved away from each other by the adjusting means 24-27 and the new working rolls 33, 34 together with the mounts 30,

31 and extend the attached spacer pieces into the stand window 2. The adjusting means are now released. The transfer of the roll forces occurs by the mounting members 12, 13, spacer pieces 35, 36 and the mounts or mounting pieces 30, 31 on the thicker working rolls 33, 34.

On removal of the spacer pieces (in FIG. 2 see the components with reference numbers 35, 36) according to FIG. 3 the two-high finishing mill stand can be used as a four-high mill stand, especially for transmitting roll forces of more than 2000 metric tons. The transmission of the roll forces then occurs directly between the backup rolls 10,11 and the working rolls 33, 34, i.e. without involving the mounting members 12, 13.

As shown in FIG. 6 both the working rolls 133, 134 and the backup rolls 110, 111 are asymmetrically shaped. They are curved differently in the direction of their ends. This is also true for the embodiment of FIGS. 1 to 2 and for the intermediate rolls 14, 15.

The features of our invention are not limited to the examples shown in the drawing. So within the general framework of our invention the spacer pieces are not required to have a special particular form and can be divided not only horizontally but also vertically. The structural form chosen is determined by the application.

I claim:

1. A rolling mill stand, comprising:

a pair of rolling mill stand frames formed with respective windows;

upper and lower backup rolls received in said frames and having respective journal blocks in said windows;

respective pairs of roll-bending blocks received in said windows below the journal blocks for said upper backup rolls and above the journal blocks of said lower backup rolls;

a respective intermediate roll engageable by each backup roll and provided at its ends with respective mounting pieces horizontally slidable into engagement with a respective pair of said roll-bending blocks for bending by fluid-operated means thereon;

a respective slender working roll braced by each of said intermediate rolls whereby said slender working rolls define a rolling gap between them, said slender working roll and the respective intermediate roll being removable axially from said stand together with the respective mounting pieces thereof while the respective roll-bending block and backup roll remain in the stand; and a pair of thick working rolls having respective mounting members journaling same at opposite ends of the thick working rolls, insertable axially in said windows and engageable with said roll-bending blocks to define a rolling gap upon removal of said intermediate rolls and slender working rolls from the stand to convert said stand from a six-high mill stand to a mill stand free from intermediate rolls, said thick working rolls being bendable by the fluid-operated means of the respective roll-bending blocks, and wherein no contact exists between each of said thick working rolls and of an adjacent one of said backup rolls during use of said rolling mill stand as a two-high mill stand said two-high mill stand having a plurality of mounts of said working rolls provided with a plurality of spacer pieces engaging against a plurality of journal blocks of said backup rolls, each of said mounts of said working rolls being fitted in at least one guide piece which acts as a guide for said mounting piece of said intermediate rolls during use of said rolling mill stand as a six-high rolling mill stand.

2. The mill stand defined in claim 1 wherein each of said slender working rolls and the respective intermediate roll form a respective quick change unit rapidly retractable from and insertable into said stand.

3. The mill stand defined in claim 1 wherein each of said spacer pieces comprises at least one plate and is releasably attached with one of said mounts of said working rolls.

4. The mill stand defined in claim 3 wherein a plurality of said plates positioned over each other form one of said spacer pieces.

5. The mill stand defined in claim 1 wherein said spacer pieces are shaped to fit together with said mounts and thus are attached with said mounts.

6. The mill stand defined in claim 1 wherein said working rolls have an asymmetric body shape curved differently in the vicinity of each end of said working roll.

7. The mill stand defined in claim 1 wherein said backup rolls have an asymmetric body shape curved differently in the vicinity of each end of said backup roll.

8. The mill stand defined in claim 1 wherein said intermediate rolls or said slender working rolls have an asymmetric body shape curved differently in the vicinity of each end of said intermediate roll or said slender working roll.

9. A rolling mill stand for making a rolled product, comprising:

a plurality of backup rolls each having an asymmetric shape curved differently in the vicinity of each end of said supporting roll mounted in a mounting member, and a plurality of guide pieces each formed to engage and hold either a mounting piece holding an intermediate roll or a mount holding a working roll so that said rolling mill stand can be easily changed from a six-high mill stand to a four-high mill stand and back again; and at least one spacer piece engageable between said supporting roll and said working roll on said mount releasably so that said rolling mill stand can be operated as a two-high mill stand.

* * * * *